US008070586B1

(12) United States Patent
D'Avanzo

(10) Patent No.: US 8,070,586 B1
(45) Date of Patent: Dec. 6, 2011

(54) SLOT MACHINE AND METHOD OF USE

(75) Inventor: Scott D'Avanzo, Ladera Ranch, CA (US)

(73) Assignee: Adrenalin Gaming, LLC, Ladera Ranch, CA (US)

( * ) Notice: Subject to any disclaimer, the term of this patent is extended or adjusted under 35 U.S.C. 154(b) by 706 days.

(21) Appl. No.: 11/252,510

(22) Filed: Oct. 18, 2005

(51) Int. Cl.
*A63F 9/24* (2006.01)

(52) U.S. Cl. ..... 463/20; 463/16; 463/17; 463/18; 463/19

(58) Field of Classification Search ..... 463/16–20
See application file for complete search history.

(56) References Cited

U.S. PATENT DOCUMENTS

| | | | | |
|---|---|---|---|---|
| 5,393,057 | A | 2/1995 | Marnell, II | |
| 5,833,537 | A | 11/1998 | Barrie | |
| 6,695,696 | B1 * | 2/2004 | Kaminkow | 463/16 |
| 2002/0160826 | A1 * | 10/2002 | Gomez et al. | 463/16 |
| 2004/0132522 | A1 | 7/2004 | Seelig et al. | |

* cited by examiner

*Primary Examiner* — Omkar Deodhar
(74) *Attorney, Agent, or Firm* — Greenberg Traurig

(57) ABSTRACT

A slot machine and method of conducting a wagering game is disclosed. The slot machine incorporates a topper having a display unit corresponding to each primary game reel. Depending on its current state, the display units turn on and turn off in response to pre-established game indicia aligning along a payline. A payout is awarded when all the display units are turned on simultaneously after a game play.

12 Claims, 5 Drawing Sheets

Fig. 4-a

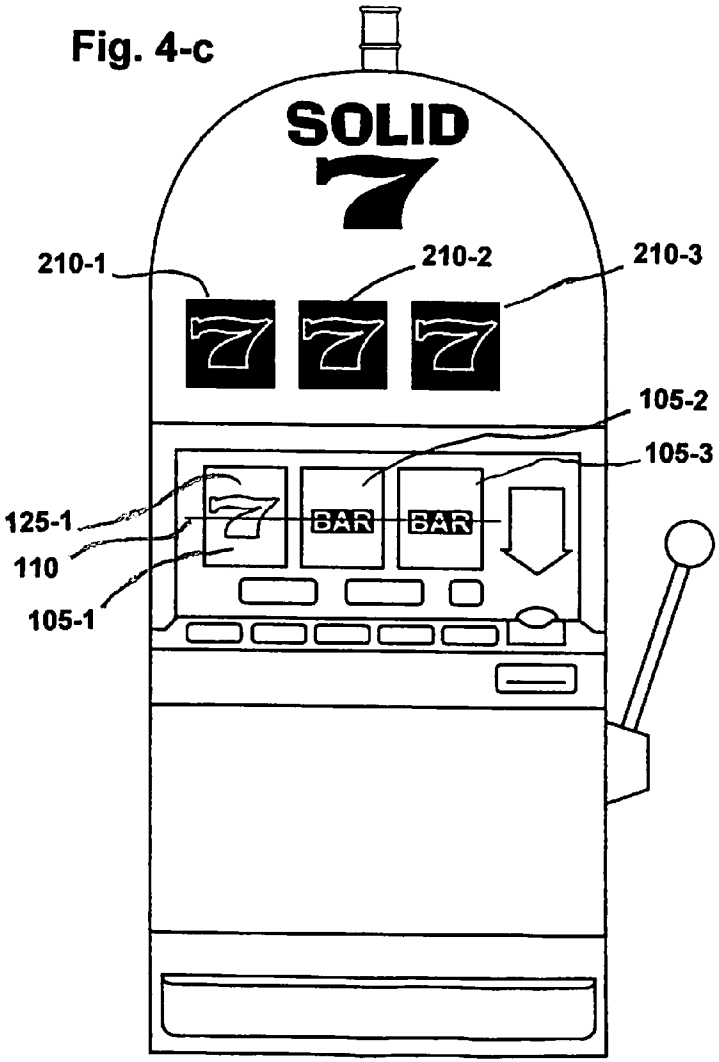
Fig. 4-c
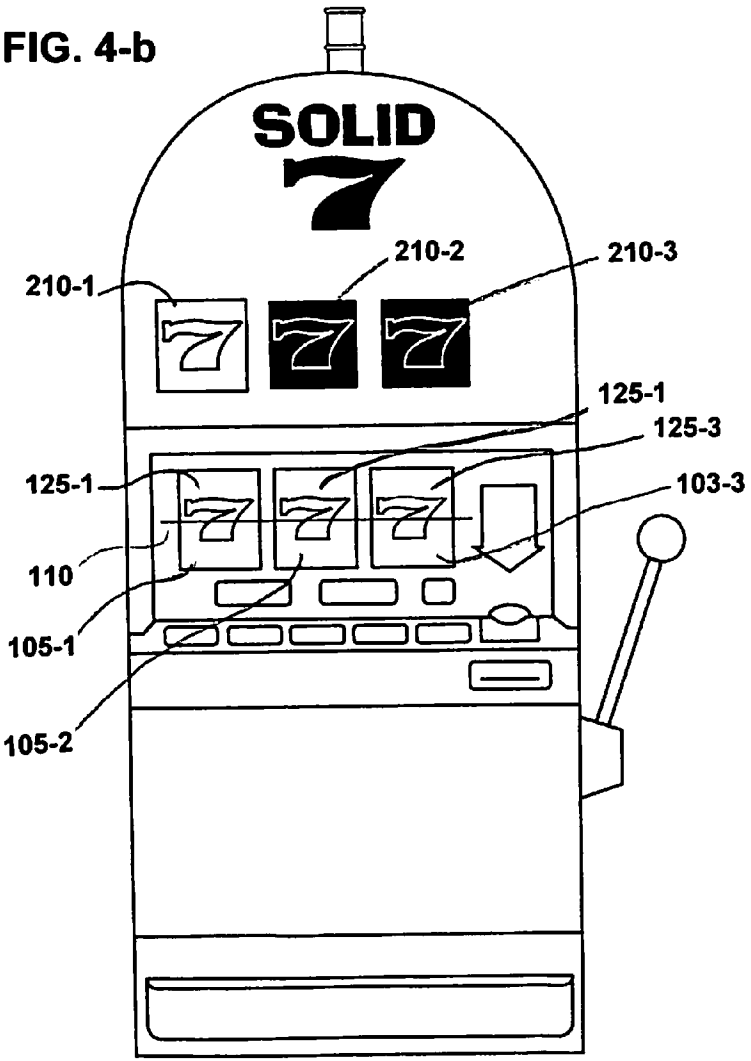
FIG. 4-b

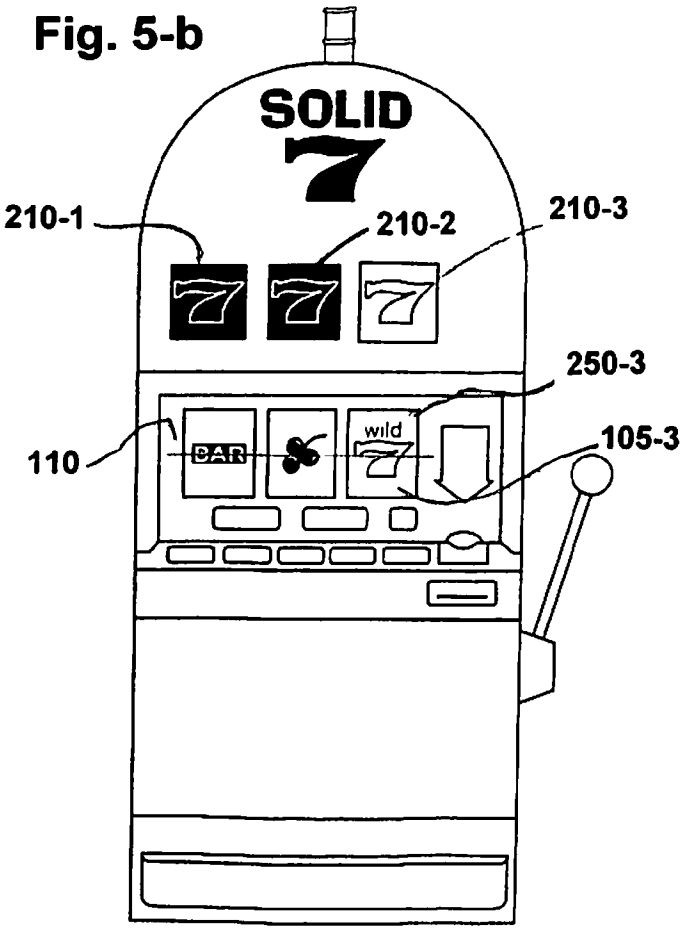
Fig. 5-b
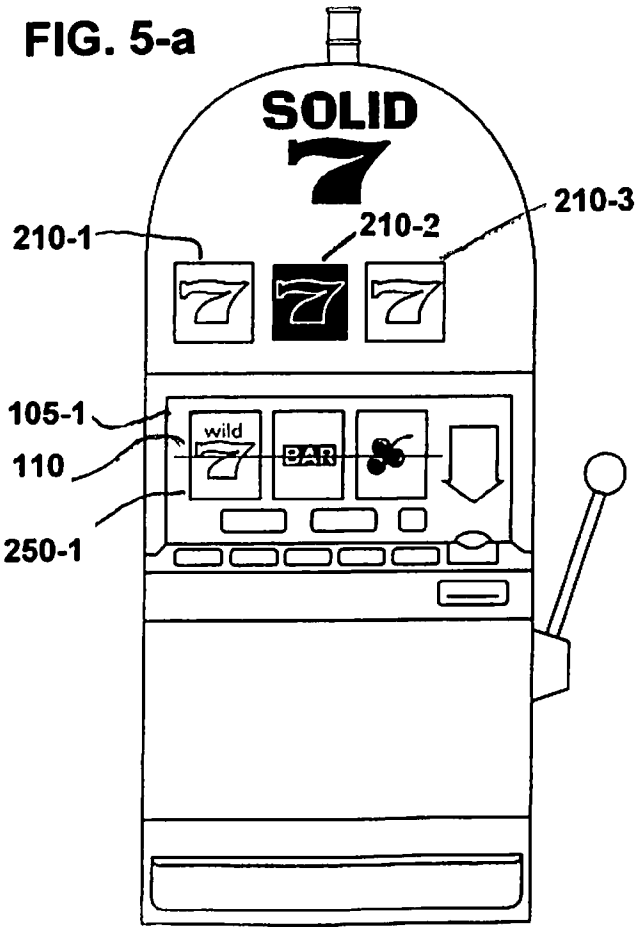
FIG. 5-a

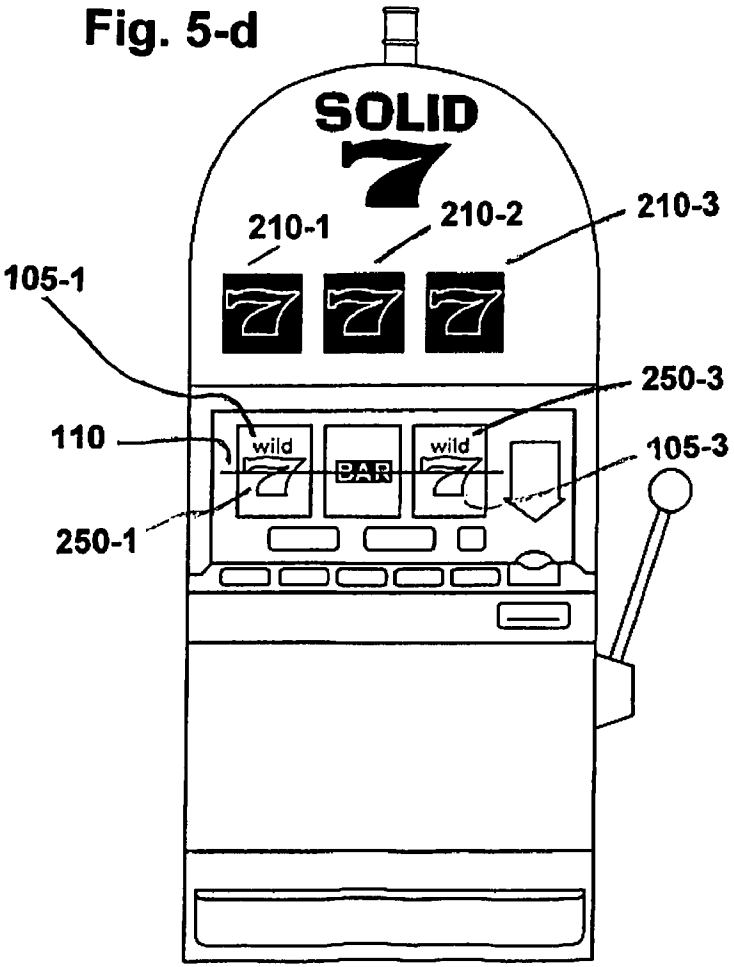
Fig. 5-d
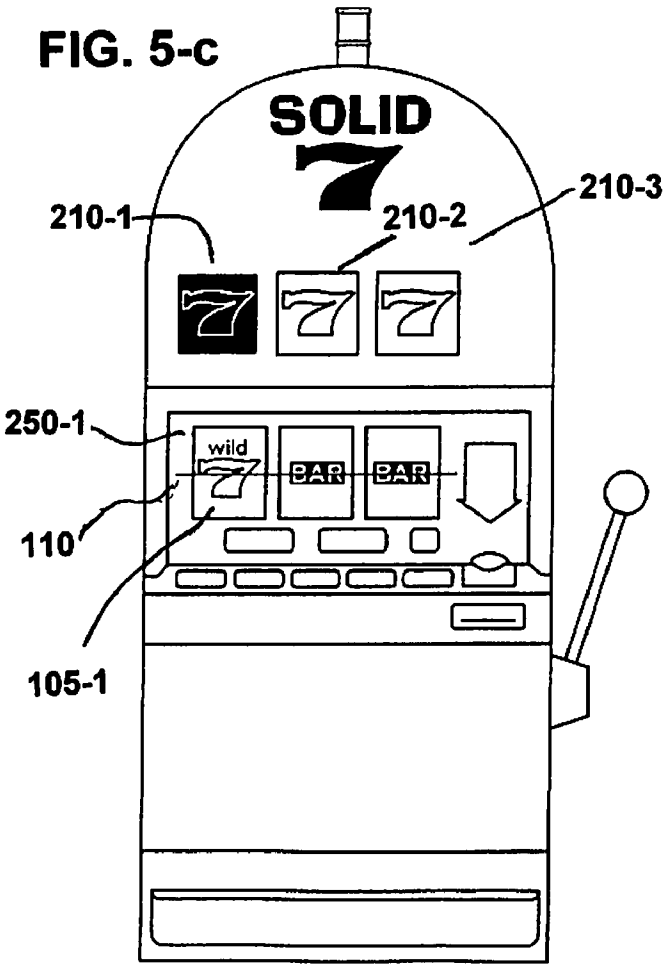
FIG. 5-c

SLOT MACHINE AND METHOD OF USE

FIELD OF THE INVENTION

The embodiments of the present invention relate to an electronic gaming device in the form of a slot machine. More particularly, the embodiments include a slot machine incorporating a topper comprising a display unit corresponding to each reel of the slot machine wherein the display units are activated in response to primary game reel outcomes to determine a bonus award.

BACKGROUND

Electronic gaming devices, like slot machines, now account for over 60% of gaming revenue in casinos. Accordingly, new slot machine concepts are in increasing demand to satisfy the gaming public. Recent slot machine advances include large progressive jackpots, video graphics and bonus games and all have been successful.

In particular, bonus games are now associated with a majority of the slot machines in the marketplace. For example, the Wheel of Fortune slot machine includes a bonus game in the form of a numbered mechanical wheel. The bonus game, namely the wheel, is activated in response to pre-established primary game outcomes. Other bonus games comprise video-implemented games, ball-hoppers and player-selected outcomes.

Even though there has been an influx of new slot machines and bonus games, the new concepts and features are of a common theme and do not add to the overall excitement level of play of slot machines.

Thus, there is a need for new and exciting slot machine concepts.

SUMMARY

Accordingly, a first embodiment of the present invention comprises a method of conducting a wagering game comprising accepting a player wager; providing means for a player to activate a series of game reels, said game reels depicting game indicia; providing a display unit corresponding to each game reel; depending on its current state causing said display units to turn on or turn off in response to pre-established game indicia aligning along a payline; and in response to all display units being turned on simultaneously at the conclusion of a game play, paying a player a corresponding award.

In one embodiment, each game reel has at least one 7 symbol thereon and the display units each depict a 7 symbol when on and a blank when off. When a 7 symbol aligns along the payline, if it was off, the corresponding display turns on, and if it was on, it turns off. If all display units are on simultaneously at the conclusion of a game play such that all display units show a 7 symbol, the player wins a bonus.

Other variations, embodiments and features of the present invention will become evident from the following detailed description, drawings and claims.

BRIEF DESCRIPTION OF THE DRAWINGS

FIGS. 4*a-c* show the slot machine of FIG. 1 with primary game outcomes causing the display units of the topper to activate; and FIGS. 5*a-d* show the slot machine of FIG. 1 with alternative primary game outcomes causing the display units of the topper to activate.

DETAILED DESCRIPTION

Figure 2:
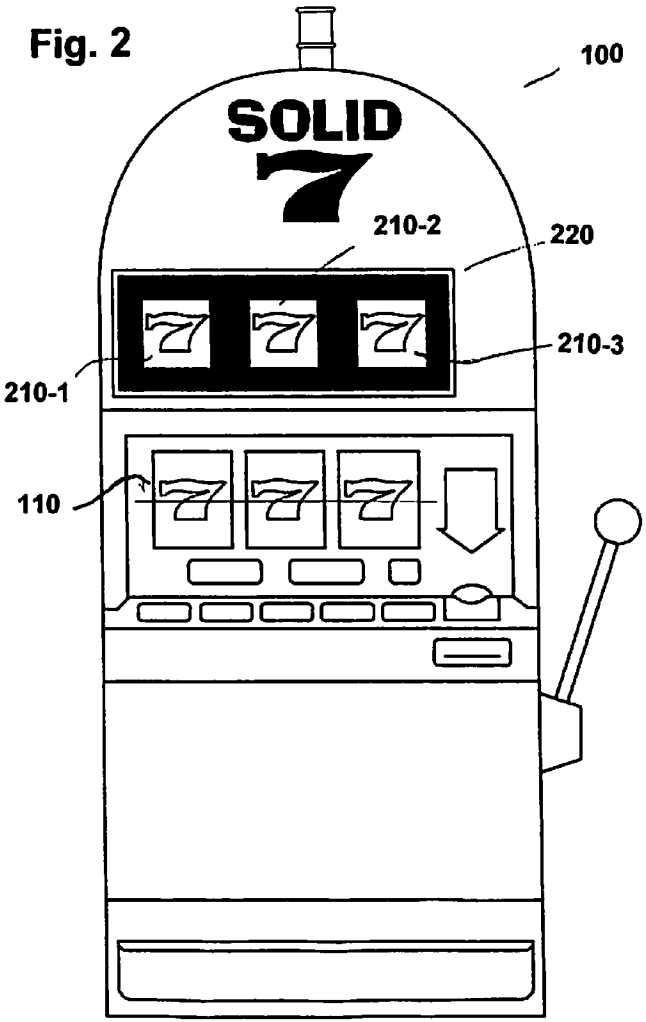
FIG. 2 shows a slot machine of a first embodiment with bonus display units facilitated by a single elongated piece of topper glass or single video display.

The operation of slot machines is controlled by microprocessors which communicate with internal memory devices and the external features of the machines. The microprocessors also incorporate, or communicate with, a random number generator which ensures the randomness of the machines' outcomes. In the embodiments of the present invention, one or more processors, along with memory and related devices, control the new applications disclosed herein. Therefore, the embodiments, along with the corresponding odds, of the present invention may be programmed into the processor or associated software. Since the technology for operating and controlling slot machines is well known to those skilled in the art, the subtle details are not described herein.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Figure 1:
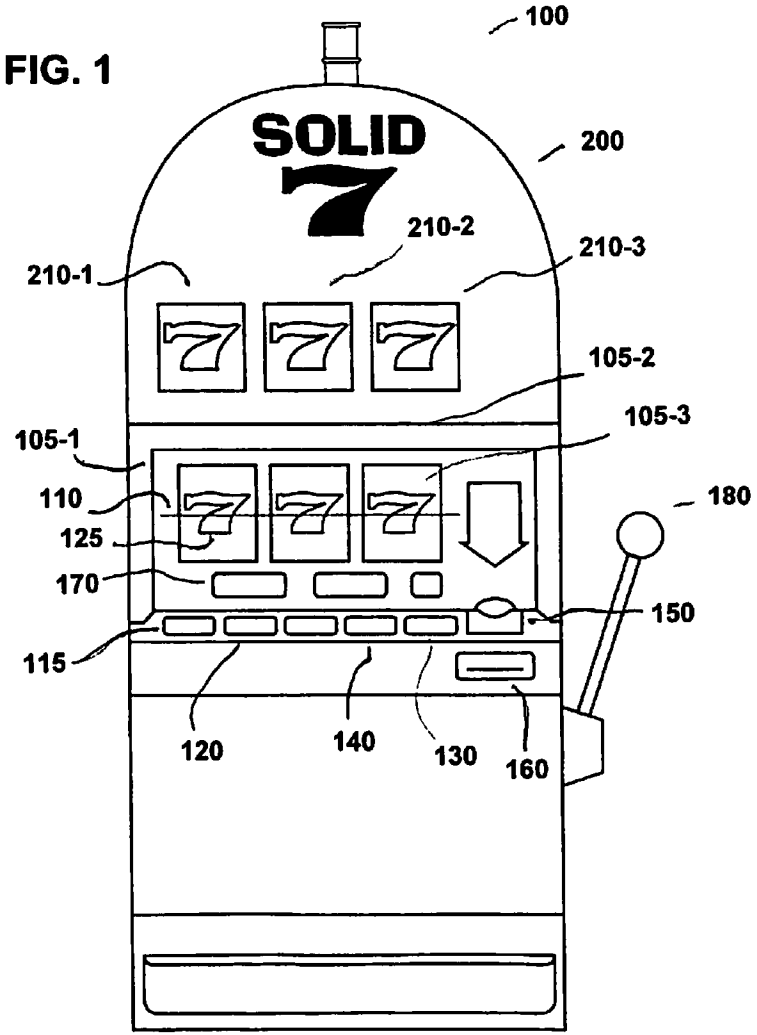
FIG. 1 shows a slot machine of a first embodiment of the present invention.

Reference is now made to the figures wherein like parts are referred to by like numerals throughout. FIG. 1 illustrates a slot machine for facilitating a first game embodiment of the present invention generally referred to by reference numeral 100. The slot machine 100 includes three game reels 105-1 through 105-3, depicting game indicia 125 and which may be mechanical or video, and a payline 110. While three game reels 105-1 through 105-3 are shown, the number may be more or less. The slot machine 100 further includes interface buttons, including a one coin/unit wager button 115, maximum coins/units button 120, spin button 130 and cash out button 140. The machine 100 also includes a coin input 150, card reader 160, credit display 170 and a slot arm 180. Optionally, the machine 100 may incorporate a currency and coupon reader.

Figure 3:
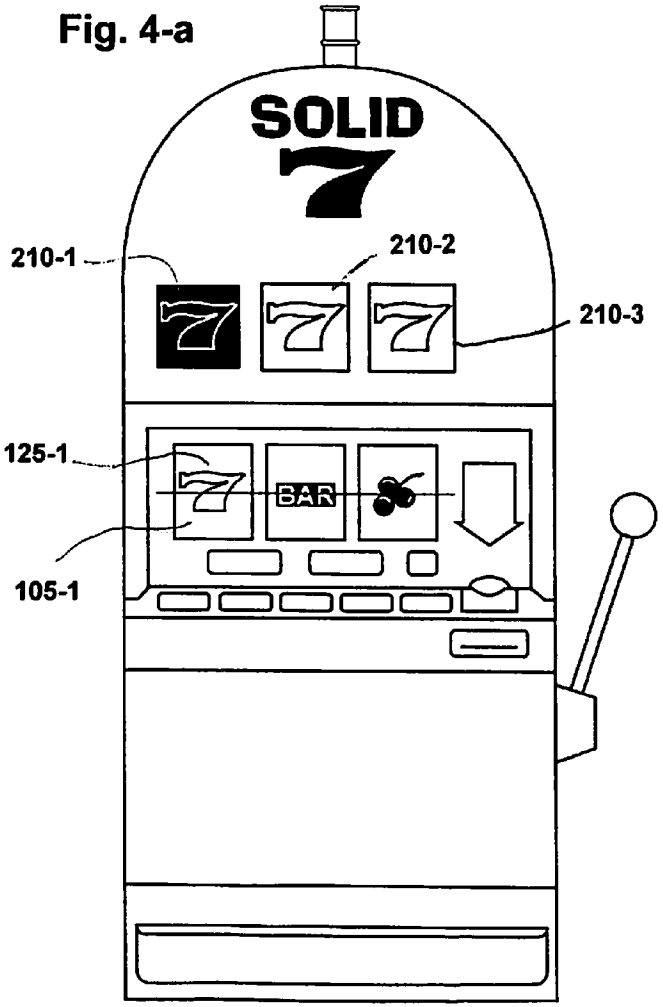
FIG. 3 shows a slot machine of a first embodiment with bonus display units facilitated by a series of topper glass members or individual video displays.
Figure 3:
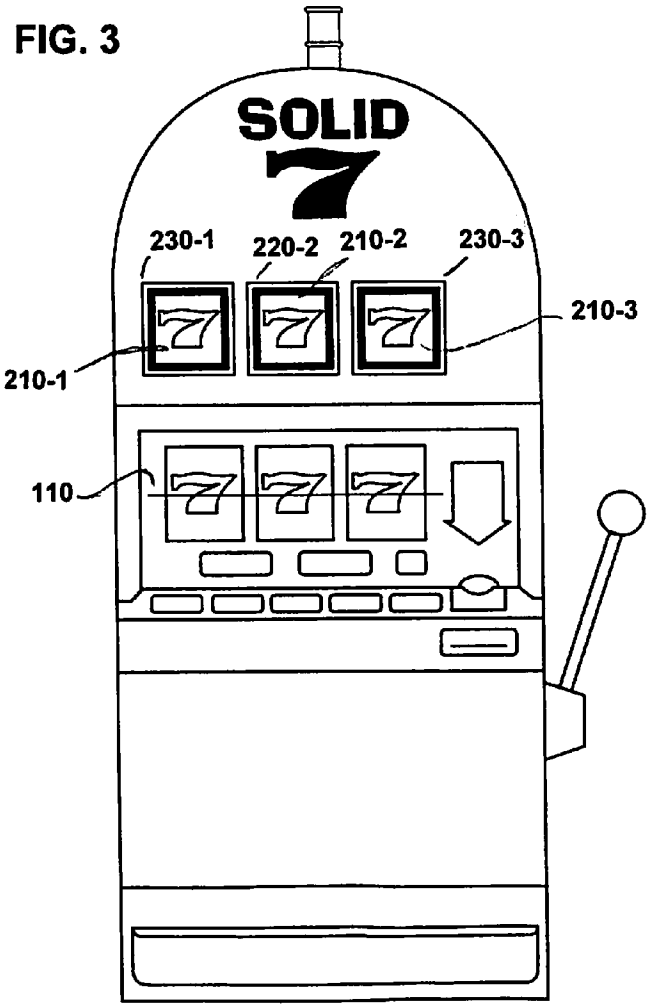

The slot machine 100 includes a topper 200 with three display units 210-1 through 210-3 corresponding to each game reel 105-1 through 105-3. The three display units 210-1 through 210-3 may either be facilitated by backlit graphics or video means. With backlit graphics, the display units may comprise three symbols (e.g., 7 symbols) depicted on a single elongated piece of topper glass with illumination sources positioned behind the topper glass. With video means, a single video display is sectioned into three areas corresponding to each display unit. FIG. 2 shows a slot machine 100' including a single topper glass or video display 220. As shown in FIG. 3, the display units 210-1 through 210-3 may also be facilitated by individual topper glass members or video display units 230-1 through 230-3.

The display units 210-1 through 210-3 are activated in response to pre-determined gaming indicia aligning along the payline 110. Accordingly, in one embodiment game reels 105-1, 105-2 and 105-3 correspond to display units 210-1, 210-2 and 210-3, respectively. Thus, display unit 210-1 is controlled by the outcome of game reel 105-1, display unit 210-2 is controlled by game reel 105-2 and display unit 210-3 is controlled by game reel 105-3. FIGS. 4*a-c* illustrate the operation of the display units 210-1 through 210-3. In response to a 7 symbol aligning along reel 105-1, the corresponding display unit 210-1 turns on or turns off depending on its current state. That is, if the display unit is off, it turns on to show a 7 symbol, if it is on, it turns off such that the 7 symbol is no longer highlighted or visible. In FIG. 4*a*, in response to the 7 symbol 125-1 of game reel 105-1 aligning along payline 110, the display unit 210-1 turns on (shown in black) since it was previously off. Display units 210-2 and 210-3 are off (shown in white). In FIG. 4*b*, the primary game outcome shows three 7 symbols 125-1 through 125-3 depicted on game reels 105-1 through 105-3 aligned along payline 110. Accordingly, corresponding display unit 210-1 turns off and display units 210-2 and 210-3 turn on. In FIG. 4*c*, game reel 105-1 depicts a 7 symbol 125-1 aligned along payline 110 causing corresponding display unit 210-1 to turn on. Consequently, all three display units 210-1 through 210-3 are turned on resulting in a bonus award. That is, in response to all display units 210-1 through 210-3 being on (e.g., illuminated), the player wins a corresponding bonus award. With backlit graphics, the display units 210-1 through 210-3 are turned on by being illuminated by a light source behind the single topper glass member or the individual topper glass members. With video displays, the displays may display a 7 symbol when they are on and nothing when they are off.

The frequency, timing and order of the 7 symbols aligning along the payline 110 are controlled by the processor of the slot machine 100. The amount of the bonus award may be fixed (e.g., 10,000 credits) or may be a progressive award that increases until it is won. The progressive award may be based on the single machine, a bank of machines or a network of linked machines from multiple casino properties. To be eligible for the bonus award, the player may be requited to play max coins or units. The embodiments of the present invention may also be facilitated over a computer network, like the Internet.

As shown above, game reel 105-1, 105-2 and 105-3 corresponds to display units 210-1, 210-2 and 210-3, respectively, such that, display unit 210-1 is controlled by the outcome of game reel 105-1 and so on. However, it is also conceivable that the different game reels may control different display units. For example, game reel 105-3 may control display unit 210-1 or the arrangement may be random in nature.

FIGS. 5*a-d* illustrate a random embodiment of the present invention. In this embodiment, a wild symbol 250-1 depicted on game reel 105-1 and aligned along payline 110 causes a randomly selected display unit to turn on or off. In FIG. 5*a*, randomly selected display unit 210-2 is shown illuminated in response to wild symbol 250-1 aligning along payline 110. In FIG. 5*b*, randomly selected display unit 210-1 is shown illuminated in response to wild symbol 250-2 aligning along payline 110. In FIG. 5*c*, randomly selected display unit 210-2 is shown in a turned off position in response to random symbol 250-1 aligning along payline 110. In FIG. 5*d*, randomly selected display units 210-2 and 210-3 are shown illuminated in response to random symbols 250-1 and 250-2 aligning along payline 110. Consequently, all three display units 210-1 through 210-3 are turned on resulting in a bonus award. While the display nits 210-1 through 210-3 appear to be randomly selected, the processor continues to control the frequency and timing with which bonus awards are won. That is, the randomness is for the benefit of the players while the game is specifically programmed to theoretically award bonus awards only so often.

The wild symbol may also cause the display units 210-1 through 210-3 to illuminate in a random, frenzied manner until one display unit 210-1 through 210-3 illuminates or turns off.

Although the invention has been described in detail with reference to several embodiments, additional variations and modifications exist within the scope and spirit of the invention as described and defined in the following claims.

I claim:

1. A method of conducting a wagering game comprising:

accepting a player wager;

providing means for a player to activate a series of game reels on a single game device, said game reels depicting game indicia;

providing a display unit on said single game device wherein said display unit depicts a static game indicia icon corresponding to each game reel in the series of game reels;

depending on a current state causing said game indicia icon on said display unit to turn on or turn off in response to pre-established game indicia aligning along a payline on a corresponding game reel as follows:

turning on a game indicia icon responsive to a said pre-established game indicia aligning along a payline on a corresponding game reel;

turning off a game indicia icon responsive to a said pre-established game indicia aligning along a payline on a corresponding game reel; and maintaining said game indicia icon turned on or turned off until a next occurrence of said pre-established game indicia aligning along a payline on said corresponding game reel at which time the game indicia again changes state; and in response to all game indicia icons being in a pre-determined state at the conclusion of a game play, paying a player an award corresponding thereto.

2. The method of claim 1 further comprising providing display units facilitated by backlit graphics.

3. The method of claim 1 further comprising providing display units facilitated by video screens or monitors.

4. The method of claim further comprising turning on a game indicia icon if it is off or turning off a display unit if it is on in response to the pre-established game indicia aligning along the payline.

5. The method of claim 1 further comprising providing three game reels and three depicted game indicia icon on said display unit.

6. A method of conducting a wagering game comprising:

accepting a player wager on a primary game;

providing means for a player to activate a series of game reels on a single game device, said game reels depicting game indicia;

providing multiple bonus display units on said single game device wherein each bonus display unit depicts a static game indicia icon, each of said bonus display units corresponding to a game reel in the series of game reels;

causing each of said display units to turn on or turn off in response to pre-established game indicia of a corresponding reel aligning along a payline such that turned on display units turn off in response to a said pre-established game indicia of a corresponding reel aligning along a payline, and turned off display units turn on in response to a said pre-established game indicia of a corresponding reel aligning along a payline, each of said display units remaining turned on or turned off until a next occurrence of said pre-established game indicia of a corresponding reel aligning along a payline; and in response to all display units being in a pre-determined state at the conclusion of a game play, paying a player a corresponding award corresponding thereto.

7. The method of claim 6 further comprising turning on a display unit by illuminating the display.

8. The method of claim 6 further comprising providing display units facilitated by video screen or monitors.

9. A slot machine comprising:

a processor having memory storing one or more executable programs;

a series of game reels depicting game indicia;

a topper comprising a display unit wherein said display unit depicts a game indicia icon corresponding to each game reel;

wherein in response to pre-established game indicia aligning along a payline on a game reel, said one or more executable programs causing a corresponding game indicia icon depicted on said display unit, depending on a current state, to turn on or turn off, such that:

turning on a game indicia icon responsive to a said pre-established game indicia aligning along a payline on a corresponding game reel;

turning off a game indicia icon responsive to a said pre-established game indicia aligning along a payline on a corresponding game reel; and each of said display units remaining turned on or turned off until a next occurrence of said pre-established game indicia aligning along a payline on a corresponding game reel; and wherein said processor further causing a payout to be awarded in response to each of said display units being in a pre-determined state at the conclusion of a game play.

10. The slot machine of claim 9 wherein the display units are facilitated by backlit graphics.

11. The slot machine of claim 9 wherein the display units are facilitated by a video screen or monitor.

12. The slot machine of claim 9 wherein the series of game reels comprise three game reels and three depicted game indicia icon on said display unit.

* * * * *